US008618394B2

(12) United States Patent
Morong

(10) Patent No.: US 8,618,394 B2
(45) Date of Patent: Dec. 31, 2013

(54) LOW-POWER SECTOR-ROTATING TOGGLING ACTUATOR

(76) Inventor: William Henry Morong, Paoli, PA (US)

( * ) Notice: Subject to any disclaimer, the term of this patent is extended or adjusted under 35 U.S.C. 154(b) by 173 days.

(21) Appl. No.: 13/374,399

(22) Filed: Dec. 27, 2011

(65) Prior Publication Data

US 2012/0167743 A1 Jul. 5, 2012

Related U.S. Application Data

(60) Provisional application No. 61/460,465, filed on Jan. 3, 2010.

(51) Int. Cl.
*G10C 3/18* (2006.01)

(52) U.S. Cl.
USPC ..... 84/343

(58) Field of Classification Search
None
See application file for complete search history.

(56) References Cited

U.S. PATENT DOCUMENTS 1,353,594 A * 9/1920 Kaisling ..... 84/343
1,538,950 A * 5/1925 Price ..... 335/181
1,962,034 A * 6/1934 Reichold ..... 335/181
2,635,138 A * 4/1953 Reisner, Jr. ..... 335/267
3,832,658 A * 8/1974 Hayden ..... 335/181
4,615,254 A * 10/1986 Klann ..... 84/343
4,726,277 A * 2/1988 Peterson et al. ..... 84/343
4,851,800 A * 7/1989 Peterson et al. ..... 335/229
5,370,029 A * 12/1994 Kramer ..... 84/339
5,608,176 A * 3/1997 Patterson ..... 84/337
2012/0167743 A1* 7/2012 Morong ..... 84/343
2013/0042743 A1* 2/2013 Morong ..... 84/339

* cited by examiner

*Primary Examiner* — Elvin G. Enad
*Assistant Examiner* — Robert W Horn

(57) ABSTRACT

The present invention provides low-power, sector-rotating, electro-magnetically and mechanically operable toggling actuator. The reluctance of the magnetic circuit of this invention is controlled to effect actuation with but little magneto-motive force and, little electrical power. The preferred embodiment of this invention provides a single-coil, sector-rotating, electromagnetically and mechanically operable toggling actuator. In this embodiment, a pivotally-mounted magnetically-permeable rotor is attracted to either of two stable rotary positions by permanent magnets affixed to a magnetically-permeable stator. A magnetic circuit between the stator and the rotor comprises an electromagnetic coil to provide magneto-motive force for toggling the rotor to a desired position responsive to the direction of electrical current through the coil. A switch may be provided for activating external circuits responsive to rotor position.

13 Claims, 7 Drawing Sheets

LOW-POWER SECTOR-ROTATING TOGGLING ACTUATOR

CROSS-REFERENCE TO RELATED APPLICATION

The present application claims the benefit of U.S. Provisional Application No. 61/460,465, filed on Jan. 3, 2010, which is incorporated herein by reference.

STATEMENT REGARDING FEDERALLY SPONSORED RESEARCH OR DEVELOPMENT

The present invention was not developed with the use of any Federal Funds, but was independently developed by the inventor.

BACKGROUND OF THE INVENTION

This invention provides an actuator well-suited for use as a Stop Action Magnet, or SAM, which may be a component of a musical instrument, especially of an organ console. In addition to claviers for accessing notes of various musical pitches at the will of the organist, an organ also usually comprises so-called stops that control plural groups, called ranks, of pipes (or of sampled or synthesized sounds) whereby many musical timbres may be selected. Small organs may comprise but a few stops, but large organs may be equipped with several tens, or even hundreds of stops. For small organs, manual stop-controls often suffice. For large organs, however, it is necessary to provide means for the organist to preset chosen stop combinations prior to a performance, subsequently to be accessed during the performance using preset buttons, called pistons. For this purpose, large organs often include a memory with presetting and access means, called a combination action. When the organist pushes a piston, pre-selected stops are electrically (sometimes pneumatically) quickly activated or deactivated as if they had been simultaneously manually selected. The electro-mechanical device that activates or de-activates each stop responsive to the combination action, or responsive to manual operation, is called a SAM.

A primal prior-art "Reisner C3" SAM is offered as part no. 5566.19 by Organ Supply Industries of Erie, Pa. Subsequent improvements to early prior-art SAM designs are taught in U.S. Pat. No. 3,832,658, U.S. Pat. No. 4,726,277, FIGS. 7&8, and U.S. Pat. No. 4,851,800, FIGS. 7, 8, and 10. These prior-art SAM's are sector-rotating designs comprising two solenoidal coils for rotor operation.

Prior-art sector-rotating SAM's comprise either a spring, or two or more permanent magnets, with at least one affixed to their rotors, to provide the toggling action required by organists. Some prior-art SAM's, for example those offered by Syndyne Corp. of Vancouver, Wash., are supplied with models having different toggle forces.

Most prior-art sector-rotating SAM's are supplied with plural rotor angle options to accommodate various organ console requirements. This plurality necessitates documentation, production, and stocking of rotors having various bend angles.

Because it is desirable for all the stop tabs (SAM handles) in a row of SAM's to rest at uniform positions, both when de-activated (up) and also when activated (down), most sector-rotating SAM's are fitted with leveling adjustments to unify their toggled positions. On the Reisner C3 SAM these adjustments are on the top and bottom of the SAM. On the SAM of U.S. Pat. No. 3,832,658 offered as part #SAM by Syndyne and in that of U.S. Pat. No. 4,726,277 offered by Peterson Electro-Musical Products, Inc., these adjustments are located on one side. Installed SAM's are often lie in closely spaced rows. The space below the lowest row of SAM'S is often occupied by the tails of the upper clavier keys. Thus, once many prior-art SAM's are installed, the only adjustment likely to be accessible is the top adjustment of a top-row Reisner SAM. It is usually inconvenient to adjust an installed prior-art SAM. For this reason, organ technicians usually adjust SAM's sequentially as they are installed rather than iteratively to dismount, adjust, and remount each SAM to level it.

The Peterson PowerTab™ literature cites its "exclusive, patented Tip Polarization" as an efficiency improvement, illustrating the importance of efficient operation. Notwithstanding this citation, prior-art SAM's usually require about three watts of instantaneous power to toggle. This large instantaneous power demand often causes prior-art SAM's to fail to operate if the supply voltage becomes loaded down. This problem often occurs when a so-called "general cancel" piston is pushed, requiring simultaneous de-activation of many SAM's. Prior-art SAM's usually utilize needle-bearing pivots, through which and around which their magnetic circuits must close. The pivots of prior-art SAMS's usually offer substantial magnetic reluctance, causing inefficiency. The needle-bearing pivots of many prior-art SAM's are prone to bearing failure after a few hundred thousand operations, necessitating inconvenient replacement.

It is not unusual for prior-art SAM's to interfere with their own switches or those of adjacent SAM's, and sometimes the operation of other parts of the instrument, to the extent that at least one instance of disruption of an organ concert due to such interference has been recorded.

Whilst it is desirable that SAM's operate silently, the deceleration of the large rotor mass of two-coil SAM's militates against this desirable characteristic.

Also taught by Peterson in U.S. Pat. No. 4,726,277, FIG. 1, is a SAM of the "draw-knob" variety preferred for classical organs. It has a single-coil like the present invention, but is very different, providing rectilinear motion and being copiously endowed with linkages. Apparently such single-coil SAM's have proven problematic in the prior-art, as Peterson's present draw-knob offering is an adapted two-coil sector-rotating device.

OBJECTS OF THE PRESENT INVENTION

A first object of this invention to provide a sector-rotating toggling actuator that toggles with less power than prior-art actuators. Another object of the present invention is to provide such an actuator that operates with but a single coil. A further object of the present invention is to provide an adjustable SAM wherein a single model is compatible with, and may easily be co-installed and co-leveled with prior-art SAM's of various makes and angles. Another object of this invention is to provide such a SAM comprising but a single set of parts, with none devoted to a particularangle, to provide an adjustable arc of rotation that can easily be angularly positioned relative to a mounting surface. A further object of this invention is to is to provide such an actuator having its adjustments readily accessible from its rear direction. Yet another object of this invention is to provide a SAM that will survive one-million or more operations. A further object of this invention is to provide a SAM that operates more quietly than prior-art SAM's. Yet another object of this invention is to provide a SAM that is less subject to magnetic interference than prior-art SAM's.

BRIEF DESCRIPTION OF THE INVENTION

The present invention provides a low-power sector-rotating toggling actuator by reducing actuator magnetic circuit reluctance. The magnetic circuit of the present invention is made relatively stout of cross-section, enabling its operation with little magneto-motive force, thus requiring but little electric actuating power. The preferred embodiment of the inventive actuator comprises a magnetically-permeable rotor, a magnetically-permeable stator fitted with permanent-magnet poles, and a coil, all disposed in a magnetic circuit. The actuator of the preferred embodiment toggles between stable positions responsive both to mechanical operation of its rotor and to application of suitably poled electrical currents through its coil. The actuator of this invention may be fitted with magnetically-permeable bushings to minimize the reluctance of its magnetic circuit. The actuator of this invention may be fitted with one or more mechanical adjustments which may be made accessible from its rear direction. The actuator of this invention may be fitted with a mounting trunnion, whereby it may be angularly adjusted relative to a mounting surface. This actuator may comprise an electrical switch responsive its rotor position.

DETAILED DESCRIPTION OF THE INVENTION

The following terms are hereby defined for this application:

The term "sector-rotation" means rotation about an axis through an arc of less than 360 degrees.

The term "angular offset" means an angle between a fixed reference surface and one extreme of an arc of sector rotation.

The term "magnetically-permeable" means having a low magnetic reluctance, as exemplified by a ferrous material such as soft steel or iron.

The term "pole" means that surface of a magnet, of a coil, or of a coil core, disposed to coact with a magnetically related member.

The term "toggle" means to move between stable positions by overcoming force that resists rest in intermediate positions, as exemplified by the action of a well-known electrical toggle switch.

The term "coil" means a current dependent source of magneto-motive force, usually comprising a coil of wire, often wound on a bobbin, that produces magneto-motive force when conducting an electrical current.

The term "magnetic circuit" means a closed or near-closed magnetically-permeable path through which the magnetic flux of a magnet and/or of a coil passes.

The term "oppositely poled" refers to magnets or coils poled mutually to attract. Oppositely poled magnets attached to a permeable member share lines of magnetic flux through that member. Conversely, the flux of like poled magnets or coils may share a member, but like poled magnets or coils insignificantly share flux.

The term "permanently lubricated" refers to mechanical bearing material which has been saturated with a lubricant or otherwise endowed with a long-lasting low coefficient of friction.

The term "SAM" means a stop action magnet, a type of actuator commonly used in organ consoles, as described above.

Figure 1:
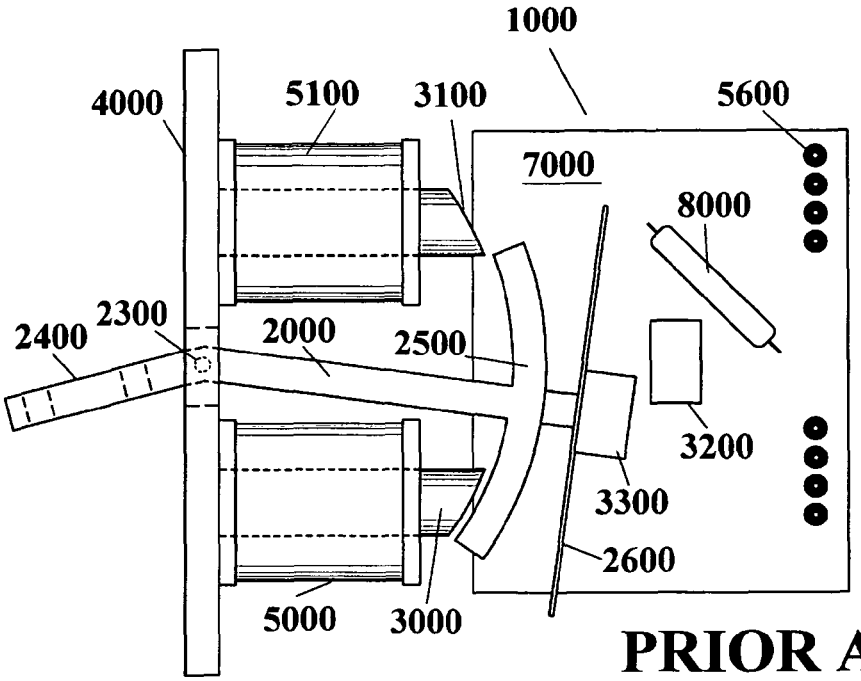
PRIOR ART Fig. 1
FIG. 1 shows a side view of a prior-art SAM.

FIG. 1 depicts a side view of a prior-art SAM 1000 comprising a magnetically-permeable rotor 2000 having a stop-tab end 2400 and a pole-piece end 2500. Rotor 2000 sector-rotates on a needle-bearing pivot 2300. The needle-tips of pivot 2300 rotate in seats in a magnetically-permeable stator frame 4000, which supports two coils 5000. Coils 5000 and 5100 surround magnetically-permeable stator pole rods 3000 and 3100, to one or the other of which poles 2500 is magnetically attracted when one of the coils is electrically energized. Activating lower coil 5000 turns rotor 2000 clockwise; activating upper coil 5100 turns rotor 2000 counter-clockwise. A magnet 3300 is affixed to a magnetically-permeable vane 2600 affixed to rotor 2000. A second magnet 3200 is affixed to a magnetically non-permeable circuit board 7000 which is fastened to stator frame 4000. Magnets 3100 are poled to repel when armature 2000 is in the center of its rotation, enforcing stable toggle positions at the extremes of rotor 2000 travel and preventing rotor 2000 from resting in an intermediate position. Affixed to circuit board 7000 is a reed switch capsule 8000 which, through conductors connected to platedthrough holes 5600, reports information about the position of the rotor 2000 to the organ console. Wires powering coils 5000 and 5100 may be connected to similar holes. Switch capsule 8000 is turned on by the magnets 3300 and 3200 when stop-tab end 2400 is depressed and pole-piece end 2500 rises. Vane 2600 optimizes the magnetic fields affecting switch capsule 8000. Pole-piece end 2500 is relatively massive, and moves at a relatively large radius relative to pivot 2300. Adding to its moment of inertia are vane 2600 and a magnet 3300. Not shown are bumpers at the travel extremes of pole-piece end 2500. At the extremes of pole-piece end 2500 travel considerable shock is thereby transmitted through circuit board 7000, to frame 4000, thence to the woodwork of the organ console, producing audible noise.

Figure 2:
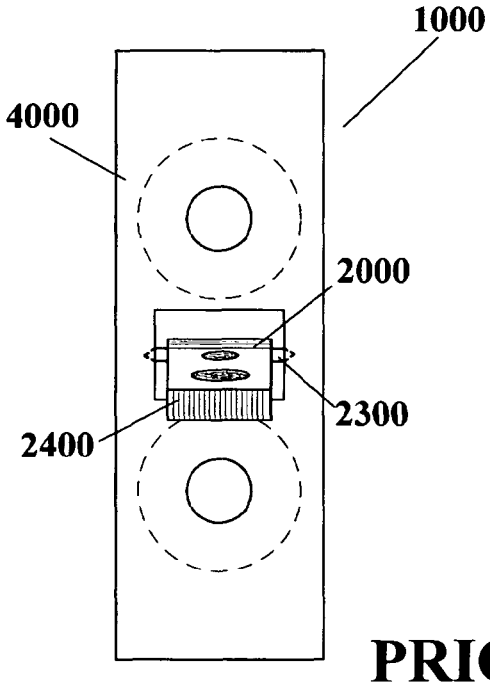
PRIOR ART Fig. 2
FIG. 2 shows a front view of a prior-art SAM.

FIG. 2 shows the prior-art SAM 1000 of FIG. 1 in front view. In this typical prior-art SAM, both above and below rotor 2000 where it passes through frame 4000, are gaps of about 0.11" (0.28 cm.), and on its sides are gaps of about 0.05" (0.127 cm.) Frame 4000 is about 0.125" (0.33 cm.) thick. Rotor 2000 is about 0.375" (0.95 cm.) wide. At toggle current, the flux densities in the gaps above and below its rotor 2000 were measured to be about 415 Gauss, using an Allegro A1302LH linear Hall-effect sensor. With upper and lower gaps providing a total area of about 0.6 square cm. we may deduce that their total flux of those gaps was about 250 Maxwells. The side gaps are too narrow to accommodate the sensor used, but based on their length, we may compute their flux densities to be about 910 Gauss. Their total area being about 0.2 square cm., we may deduce that they conducted about 183 Maxwells. Could pivot 2300 pin have conducted sufficient flux, there would have been little flux measured in the gaps, but it is evident that the pivot pin 2300 was saturated. Being a mere 0.063" in diameter, they provide a tiny total cross section of about 0.04 square cm. of steel, which at saturation might conduct About 600 Maxwells of flux. The total flux was, therefore about 1033 Maxwells.

One CGS unit of reluctance is one Gilbert per Maxwell, being also the reluctance of a one centimeter cube of vacuum and, practically, of air. The gaps above and below the rotor 2000 have lengths of about 0.28 cm., which divided by an area about 0.6 square cm., yield about 0.467 CGS units of reluctance. The side gaps, with lengths of about 0.127 cm., divided by an area of about 0.2 square cm. yield about 0.635 CGS units of reluctance. Computing the reciprocal of the sum of the reciprocals of these two reluctances yields an incremental reluctance of about 0.27 CGS units for the gap between frame 4000 and rotor 2000 once the pivot 2300 pin has saturated. The pole gaps of this prior-art SAM, being about 0.02 cm in length, divided by 0.315 square cm. of area, yield a reluctance of only about 0.064 CGS units, one pole being active in each toggle position. The remainder of the magnetic circuit being stout and of steel offers but little reluctance. Since magneto-motive force drops across magnetic-circuit reluctances of a in proportion to those reluctances, one may see that in this prior-art SAM most of the magneto-motive force generated by the coils 5000 was wasted around pivots 2300 rather than doing useful work. Loss of magneto-motive force incurred by a high reluctance magnetic circuit usually wastes coil power. The measured instantaneous power needed to toggle this prior-art SAM was about three watts, much of which was wasted.

Figure 3C:
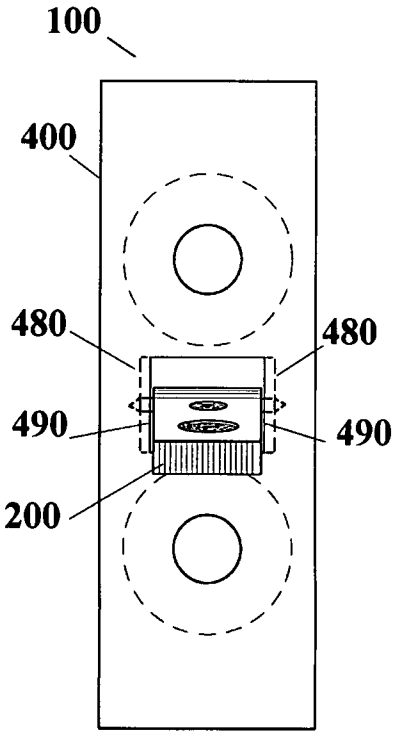
FIG. 3C shows a front view of a SAM with gap-narrowing.
Figure 3B:
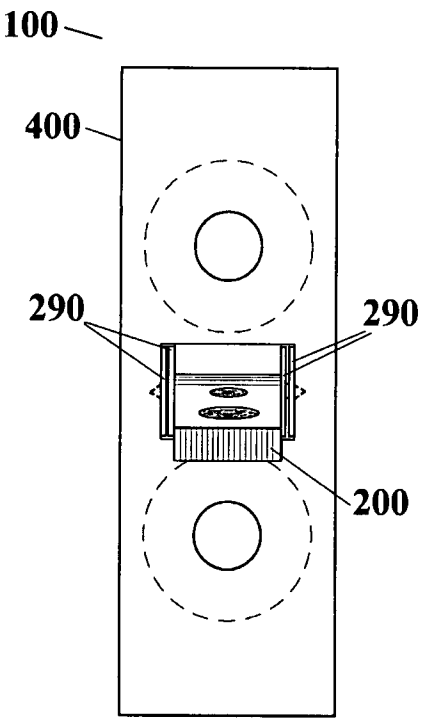
FIG. 3B shows a front view of a SAM with magnetic shunts.
Figure 3A:
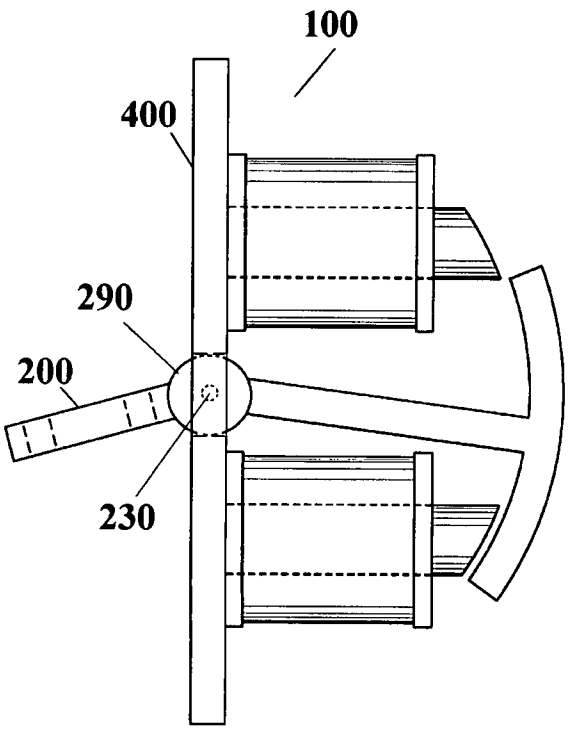
FIG. 3A shows a side view of a SAM with magnetic shunts.
Figure 4:
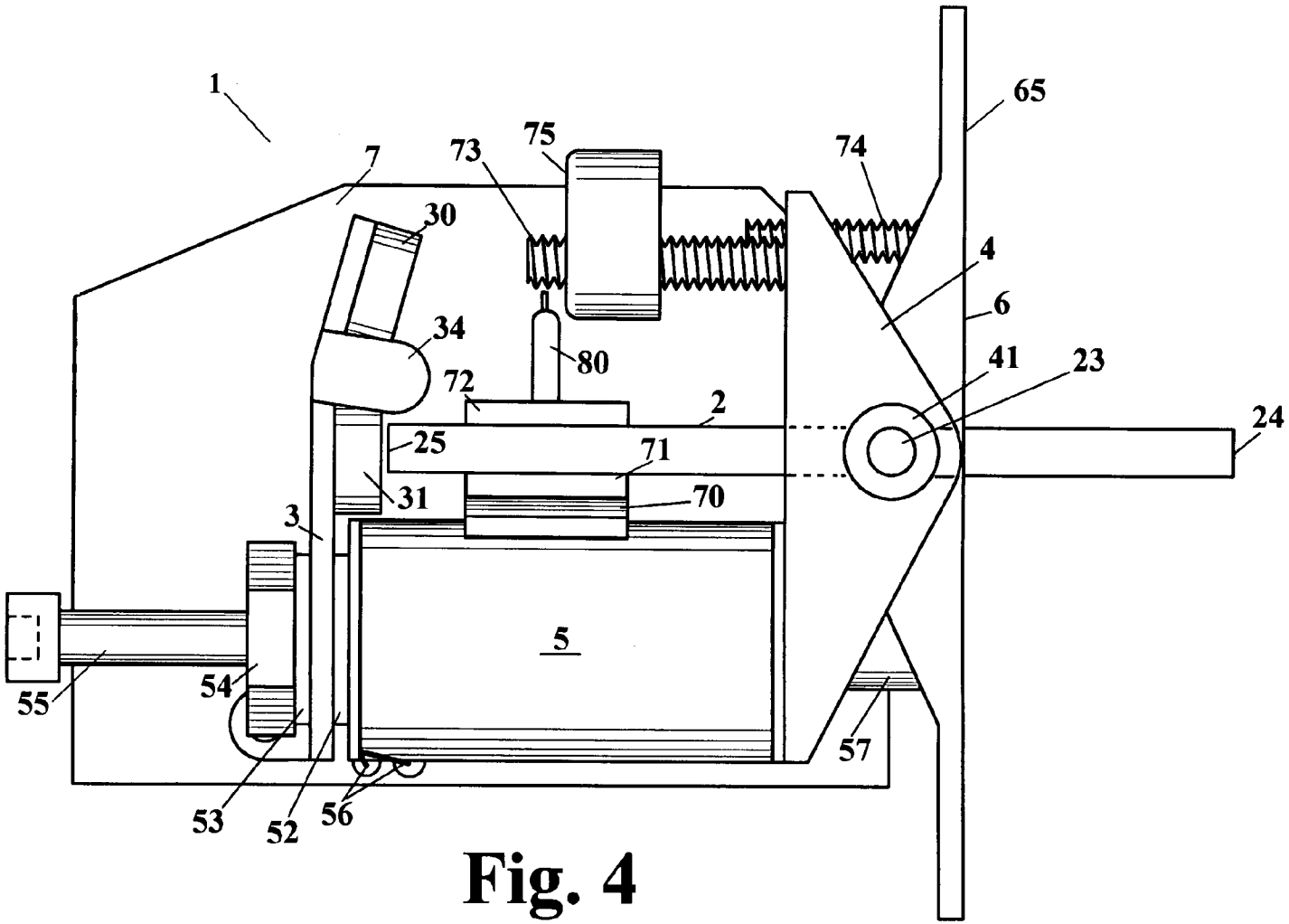
FIG. 4 shows a side view of a single-coil actuator, the preferred embodiment of the present invention.

FIG. 3A shows a partial side view of a two-coil stop action magnet 100 having a stator frame 400 which is analogous to both the prior-art stator frame 4000 of FIGS. 1 and 2, and to the stator 3 and trunnion 4 of FIG. 4. A rotor 200, is analogous to both the prior-art stator frame 2000 of FIGS. 1 and 2, and to the rotor 2 of FIG. 4. In the gap between the rotor 200 and the frame 400 are fitted one or more magnetic shunts 290 surrounding pivot 230, that pivot being analogous to pivot 2300 of FIGS. 1 and 2 and to pivot 23 of FIG. 4. Shunts 290 are made of a magnetically-permeable material to provide a low reluctance path around pivot 230, thus reducing magnetic circuit reluctance reduction in accordance with the present invention.

FIG. 3B shows a front view of the stop action magnet 100 of FIG. 3A. One or more shunts 290 may be applied in the form of washers running free in the gap between stator frame 400 and rotor 200, or may be affixed to or manufactured as part of frame 400 and/or of rotor 200 to practice this invention.

FIG. 3C shows yet another arrangement for magnetic circuit reluctance control according to this invention. Here the inner walls of frame 400 have been moved, from prior-art positions 480, to new positions 490 according to this invention. These new positions are closer to rotor 200 to achieve a shorter gap in the magnetic circuit. A alternative method of embodying this invention may be practiced by making rotor 200 wider where it passes through frame 400.

FIG. 4 shows a left-side view of a the preferred embodiment of a sector-rotating toggling actuator 1 according to the present invention. A magnetically-permeable rotor 2 has a stop-tab end 24 and a pole-tip 25. Near its center, rotor 2 is fitted with a steel pivot 23. Adjacent to pole-tip 25, is a stator 3 bearing an upper magnet 30 and lower magnet 31. Between the magnets is an inter-pole 34. Stator 3 is penetrated by a hole through which pass an ordinary steel cap-screw 55, and a threaded steel coil-core, to be described below. External threads on the core are engaged to secure stator 3 thereto by a nut 54 pressing on a washer 53. A steel shim 52 is interposed between a shoulder on the core and stator 3, for setting of the gap between magnets 30 and 31 and pole-tip 25, and thereby the toggling torque, typically 1.5 inch-ounces, of this inventive SAM. Coil 5 surrounds the aforementioned steel core which closes the portion of the magnetic circuit between stator 3 and a trunnion 4. Trunnion 4 has a rear wall which is penetrated by an orifice allowing passage of rotor 2, and two sides walls both of which are penetrated by hole. Into this hole in each wall of trunnion 4 is pressed a ferrous bushing 41. Rotating in the bores of bushings 41 is a pivot pin 23, which also passes through an orifice in rotor 2. Thus from rotor 2 though stator 3, through coil 5, through trunnion 4, through bushing 41, and through pivot 23 back to rotor 2 there exists a stout magnetic circuit of magnetically-permeable materials, according to this invention. Only the gap completing the magnetic circuit between to pole-tip 25 and stator 3 contributes significant reluctance to this magnetic circuit.

A crucial aspect of this invention is control of magnetic circuit reluctance, concentrating it in the gap between pole-tip 25 and the magnets 30 and 31 of stator 3. The stray magnetic field density adjacent to the entire magnetic circuit of this invention was mapped using an Allegro A1302LH linear Hall-effect sensor, typically measuring less than 7 Gauss, save adjacent to bushings 41 where about 15 Gauss was measured and, as expected, immediately adjacent to the gap at the pole-tip 25 of rotor 2, where the field strength exceeded sensor range. The reluctance of the magnetic circuit of actuator 1, exclusive of the pole-tip gap, being approximately 0.020 CGS units, is far less than that of prior-art SAM's. The measured actuator 1 toggled reliably with an instantaneous toggling power of but one watt, a notable reduction relative to prior-art SAM's. High permeability steels might be used to practice this invention with dimensions different than those cited here, however such a selection may be problematic unless the material chosen offers higher saturation flux density than soft steel. It should be noted that magnetically-permeable shunts such as permeable washers surrounding their pivots, or equivalent magnetic closures, could be added in the region of the needle-bearing pivots of prior-art SAM's to practice magnetic circuit reluctance reduction according to this invention.

Pivot 23 rotates freely in bushings 41 through an angle of about 16 degrees, near the extremes of which it is attracted to either magnet 30 or 31. Due to this attraction, rotor 2 will not rest save in its extreme positions, and requires torque, to be toggled between its extreme positions. Setting toggling high torques will require greater magneto-motive force for electromagnetic toggling than setting low torques. It should be noted that relative to those of prior-art SAM's, rotor 2 of this invention has less mass, which reduces audible noise. Actuator 1 is durable, a prototype having been subjected to over one-million operations without detectable degradation.

Actuator 1 toggles thusly: Let us assume that pole-tip 25 is resting near magnet 31. When current flows through coil 5 in a first polarity, pole-tip 25, as part of the aforementioned magnetic circuit, is repelled by magnet 31. Its field is poled to attract it to magnet 30, but the distance thereto is too great to toggle rotor 2 without an intermediate force. Mechanical force exerted by an attracting electromagnet seeks to minimize magnetic circuit reluctance. Therefore, when pole-tip 25 is repelled from lower magnet 31, it is simultaneously attracted to the edges of electro-magnetic inter-pole 34. Its rotation toward upper magnet 30 increases the intimacy between pole-tip 25 and inter-pole 34, decreasing gap reluctance, until pole-tip 25 reaches a center position between magnets 30 and 31. Upon reaching center position, pole-tip 25 is strongly attracted to and rotates toward magnet 30, where it rests stably until rotor 2 is either manually toggled, or until current of opposite polarity is passed through coil 5. Should coil 5 be thus reversed, rotor 3 toggles as described above, but oppositely, until pole-tip 25 then rests once again near magnet 31. Electromagnetic inter-pole 34 is an important aspect of this invention, without which greater coil power would be needed to provide reliable toggling.

It is necessary not only to toggle actuator 1, but also adjustably to restrict its sector-rotation, and to do so quietly. To this end, rotor 2 is fitted with adhesively attached elastomeric pads 71 and 72. Adhesivly attached to the top of coil 5 is a similar-sized patch 70 of felt. Pad 71 and patch 70 quietly limit counter-clockwise rotation of rotor 2. A stud 73, permanently pressed into trunnion 4, bears an off-center bored cylindrical cam 75, which by friction is difficult to rotate on stud 73, but may be rotated from the rear of this actuator 1 to adjust the distance from its surface to pad 72 on rotor 2. By rotating cam 75, the angle of sector rotation of rotor 2 may be adjusted. Pad 72 mitigates the noise and rebound of stopping clockwise rotation of rotor 2.

Trunnion 4 is formed of a channel, inside which rests a similarly shaped and narrower mounting trunnion 6, and through an aperture in the front wall of which rotor 2 passes, and the side walls of which are penetrated by a hole, in which freely rotates bushing 41. Passing through a threaded hole in trunnion 4 is a set-screw 74, preferably about 0.5" long, 4-40 thread, nylon tipped, that bears on the inside rear surface of mounting trunnion 6. Passing though coil 5 and engaging an internal thread in the core to be described below, is screw 55, which further penetrates a hole in trunnion 4. The tip of screw 55 is fitted with a cap 57 which transmits its force to the inside rear surface of mounting trunnion 6. Since screws 55 and 74 are rotationally opposed on mounting trunnion 6, tightening both locks them. By loosening one screw and tightening the other, trunnion 4 may be angularly adjusted relative to mounting trunnion 6. Thus the entire actuator 1, save mounting trunnion 6, may be adjusted to a desired angular offset relative to the organ console. Using this adjustment and that of cam 75, both the angular offset and the sector-rotation range of a stop-tab attached to rotor 2 may be adjusted relative to an organ console. Surface 65 is the usual surface for mounting to an organ console. The trunnion and rotor adjustments are made from the rear of this actuator 1 according to this invention.

Shown mounted on a circuit board 7 is a reed switch capsule 80 to be magnetically activated by rotation of rotor 2. It should be noted that the axis of switch 80 is perpendicular to the axis of coil 5 to avoid interference. Such orthogonal arrangement is less practical in two-coil SAM's, in which considerable difficulty in positioning reed switches is customary. For compatibility, the reed switch is preferred for embodiments of this invention intended for replacement of installed SAM's, but this invention may be practiced with other switch types to report rotor 2 position. Other magnetic switches, opto-electronic switches, capacitive switches, ultrasonic switches, or even mechanical switches may be used. Circuit board 7 also receives leads 56 of coil 55 for connection to organ console circuitry.

Figure 5:
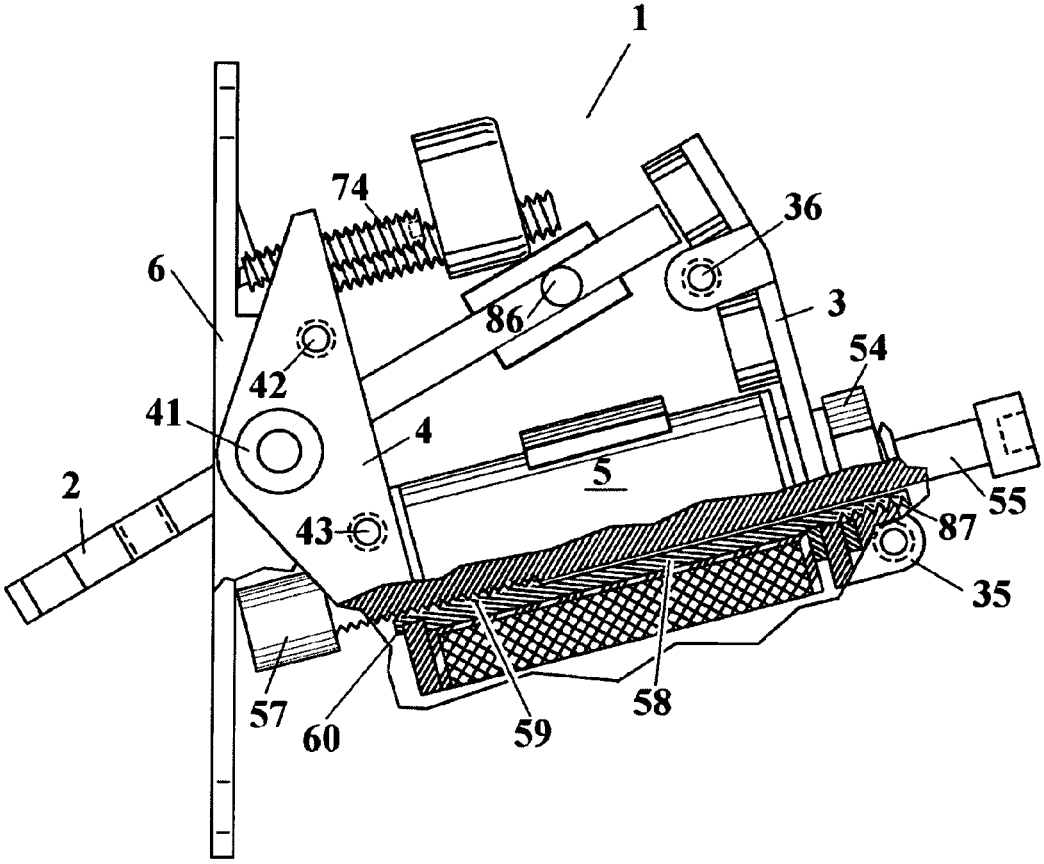
FIG. 5 shows details of the actuator of FIG. 4.

FIG. 5 shows a right side view of actuator 1 with the circuit board 7 of FIG. 4 removed to reveal details. In this figure rotor 2 has been toggled to its lower (activated) position. Also the entire actuator 1, save mounting trunnion 6, has been rotated counter-clockwise on bushing 41 with respect to mounting trunnion 6 to effect a new stop-tab angle. The nylon tip of set screw 74 is seen pressing against mounting trunnion 6, and set screw 74 has been partially screwed out of trunnion 4. Screw 55 has been screwed in to extend cap 57 to maintain pressure in opposition to screw 74. Part of mounting trunnion 6 has been broken away to reveal cap 57. The lower part of the actuator 1 has been sectioned to reveal details the aforementioned core, 58 that penetrates coil 5. Nut 54 is seen to engage an external thread 87 on the rear of core 58. Toward the front of core 58 may be seen an internal thread 59 which engages screw 55. Core 58 is secured to trunnion 4 by a swage 60. A magnet 86, may be seen imbedded in the right side of rotor 2 which, in the rotor 2 position shown, activates the reed switch 80 of FIG. 4. Magnet 86 has little interaction with the magnetic circuit described above and plays no part in the toggling of the actuator 1, its sole purpose being to operate switch 80 of FIG. 4. The right side of trunnion 4 is penetrated not only by the hole for bushing 41 but also by two small tapped holes 42 and 43 used for mounting circuit board 7 of FIG. 4. Tapped holes 35 and 36 in stator 3 are also provided for the same purpose.

Figure 6A:
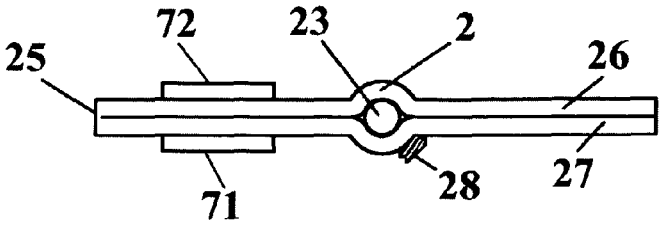
FIG. 6A shows a side view of the rotor of the actuator of FIG. 4.

FIG. 6A shows a left-side view of rotor 2. Two bars 26 and 27, preferably of soft steel 0.375" wide and 0.063" thick, are compressed around a mandrel to create an aperture into which pivot pin 23 is tightly fitted and retained by a set-screw 28, or by an adhesive. Bars 26 and 27 are preferably bonded tightly together by rivets, spot-welding, or other well-known means. One end of the joined bars 26 and 27 comprises pole-tip 25, whilst the other end comprises a lever for stop-tab attachment. Pivot pin 23 is preferably an ordinary steel dowel pin 0.125" in diameter by 0.625" long, normally supplied hardened and ground properly to function as a journal. Many methods may be employed to make rotor 2, for example the entire rotor with an integral pivot 23 can be machined, or the rotor can be molded and sintered by well-known powder metallurgy methods, all to practice this invention. Adhesively attached to rotor 2 are shown pads 71 and 72, preferably about 0.5" long, 0.375" wide, and 0.063" thick, of Gallagher Corp. GC965 material.

Figure 6B:
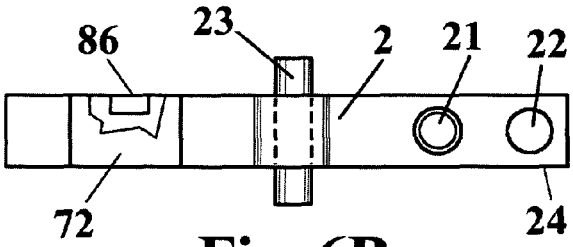
FIG. 6B shows a top view of the rotor of the actuator of FIG. 4.

FIG. 6B shows a top view of rotor 2. The journals formed by protrusions of pivot pin 23 are visible. Near its stop-tab (handle) end 24, rotor 2 is penetrated by a threaded hole 21 and an clear hole 22, for stop-tab attachment. Magnet 86, preferably of Neodymium-Iron-Boron, 0.125" in diameter and 0.063" thick, for activating switch 80 of FIG. 4 is seen imbedded in the side of rotor 2, where it is adhesively affixed. Pad 72 has been shown broken away to reveal magnet 86.

Figure 7A:
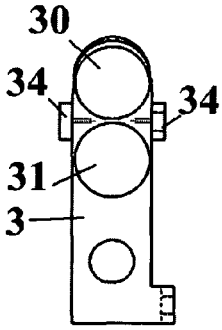
FIG. 7A shows a front view of the stator of the actuator of FIG. 4.
Figure 7B:
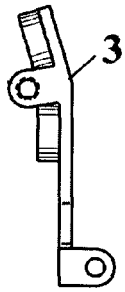
FIG. 7B shows a side view of the stator of the actuator of FIG. 4.

FIG. 7A shows a front view of stator 3 of FIG. 4 which is preferably made of soft steel approximately 0.063" thick. To stator 3 are adhesively attached upper magnet 30 and lower magnet 31, preferably of grade 5 ceramic, 0.375" in diameter and 0.125" thick, so poled that opposite poles face pole-tip 25 of FIG. 4, for example magnet 30 might present a North pole whilst magnet 31 presents a South pole to pole-tip 25, from which a face of one of the magnets is separated by a narrow gap in FIGS. 4 and 5. Between the magnets are inter-poles 34, each about 0.188" in height and protruding about 0.313", preferably integral with stator 3 and bent up from same. FIG. 7B shows a right-side view of stator 3.

Figure 8A:
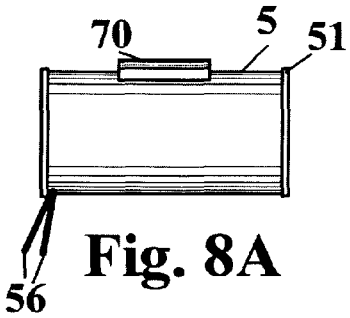
FIG. 8A shows a side view of the coil of the actuator of FIG. 4.
Figure 8B:
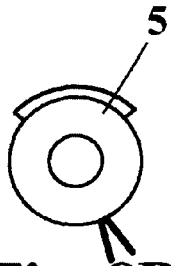
FIG. 8B shows a end view of the coil of the actuator of FIG. 4.

FIG. 8A shows coil 5 of FIGS. 4 and 5, which comprises a bobbin 51, preferably nylon and about 1.175" long, and having an outer diameter of about 0.625" and an inner diameter of about 0.250". Coil 5 also comprises a winding of, for 12 volt operation, about 3200 turns of #33 magnet wire, having a resistance of about 80 ohms, and having wire leads 56 through which its current is connected. Coil 5 may be protected, if desired, with tape or shrink-tubing applied to its cylindrical surface. Adhesivly attached to the top of coil 5 is patch 70, preferably 0.063" of thick dense wool felt about 0.5" square. FIG. 8B shows an end view of coil 5.

Figure 9A:
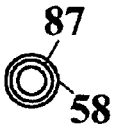
FIG. 9A shows a rear view of the core of the actuator of FIG. 4.

FIG. 9A shows a rear view of the end of core 58 with shoulder 87. Core 58 is hollow and clears screw 55 of FIGS. 4 and 5, save for the internal thread of its front portion, shown in FIG. 5, which engages the thread of screw 55 of FIGS. 4 and 5.

Figure 9B:
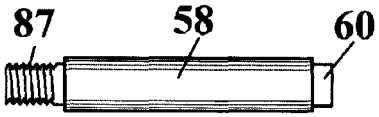
FIG. 9B shows a side view of the core of the actuator of FIG. 4.

FIG. 9B is a left-side view of core 58, preferably made of soft steel about 1 0.250" in outer diameter. On the rear of core 58 is shown a turned step 87 about 5 mm in diameter and externally threaded to engage nut 54 of FIGS. 4 and 5. At the front of core 58 is another step 60, here shown prior to swaging into trunnion 4 of FIGS. 4 and 5. This same step 60 is shown swaged in FIG. 5, securing core 56 to trunnion 4.

Figure 9C:
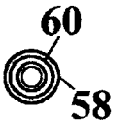
FIG. 9C shows a front view of the core of the actuator of FIG. 4.

FIG. 9C shows a front view of core 58 with its un-swaged step 60.

Figure 10A:
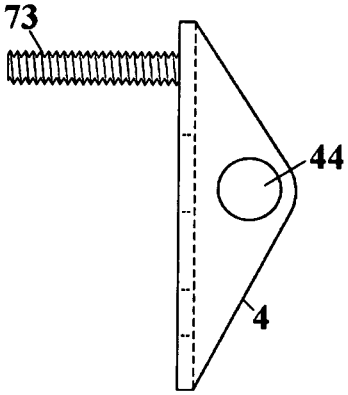
FIG. 10A shows a left-side view of the trunnion of the actuator of FIG. 4.

FIG. 10A is a left-side view of trunnion 4 of FIG. 4, which is preferably made of soft steel about 0.063" thick. Into it is pressed a stud 73, preferably of non-magnetic stainless steel, 0.75" long and having a 6-32 thread. Also shown is a hole 44, preferably 0.250" in diameter, into which is to be pressed ferrous bushing 41 of FIGS. 4 and 5.

Figure 10B:
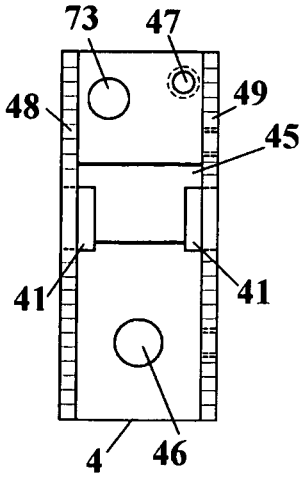
FIG. 10B shows a front view of the trunnion of the actuator of FIG. 4.

FIG. 10B is a front view of trunnion 4, showing an aperture 45 though which rotor 2 of FIGS. 4 and 5 passes. The embedded head of stud 73 is shown, as is a threaded hole 47 that engages screw 74 of FIGS. 4 and 5. The edges of walls 48 and 49 of this trunnion are here visible. In addition to their mechanical function, these walls provide additional cross-section to the magnetic path through bushings 41 and pivot 23 of FIGS. 4 and 5. Also shown is a hole 46 into which is to be swaged the shoulder 60 of core 58 of FIG. 10, as shown in FIG. 5. Also shown pressed into holes in trunnion 4 are magnetically-permeable bushings 41. It is to be understood that when these bushings are pressed into position their inner ends are to engage mating holes in mounting trunnion 6 of FIG. 4. Ferrous bushings 41, are preferably composed of so-called "SAE 863 bronze", having a 0.125" bore, a 0.250" nominal outer diameter, and 0.125" length. There actual outer diameter is usually about 0.252" making them a tight press fit in the holes of trunnion 4. The so-called bronze of these bushings has been chosen for its high iron content, which adds but little reluctance to the magnetic circuit described above. This material is porous and "permanently lubricated" by saturation with a lubricant. Other bushing materials may be used to practice this invention, as ordinary soft steel makes a functional permeable bushing if one is diligent occasionally to lubricate it.

Figure 10C:
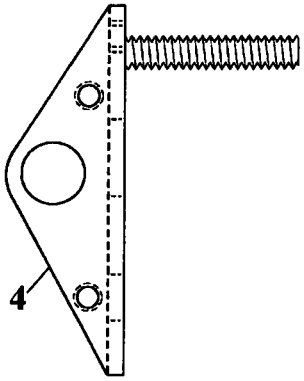
FIG. 10C shows a right-side view of the trunnion of the actuator of FIG. 4.

FIG. 10C is right side view of trunnion 4.

Figure 11A:
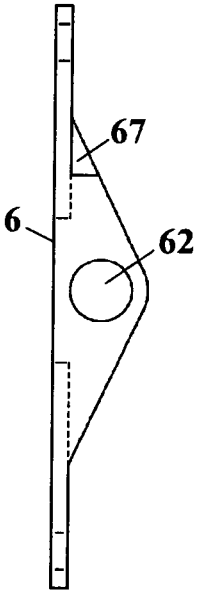
FIG. 11A shows a right-side view of the mounting trunnion of the actuator of FIG. 4.

FIG. 11A is a right-side view of mounting trunnion 6 of FIGS. 4 and 5, which is preferably made of soft steel about 0.063" thick. A hole 62, preferably about 0.252" in diameter, which freely engages a bushing 41 of FIG. 10B, is shown, as is a cutout 67 that provides room for the tip of screw 74 of FIGS. 4 and 5.

Figure 11B:
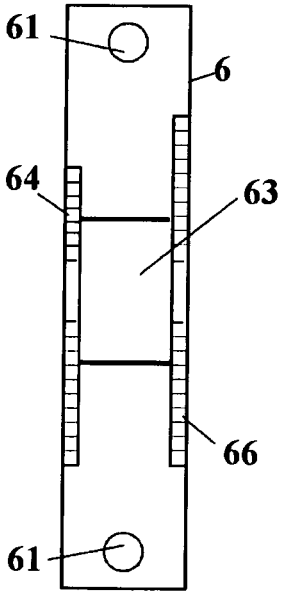
FIG. 11B shows a rear view of the mounting trunnion of the actuator of FIG. 4.

FIG. 11B is a rear view of mounting trunnion 6, showing an aperture 63 through which rotor 2 of FIGS. 4 and 5 passes. The edges of walls 64 and 66 of this mounting trunnion are here visible. In addition to their mechanical function these walls provide additional cross-section to the magnetic path through bushings 41 and pivot 23 of FIGS. 4 and 5. Mounting holes 61 are provided for fastening this mounting trunnion to the organ console.

Figure 11C:
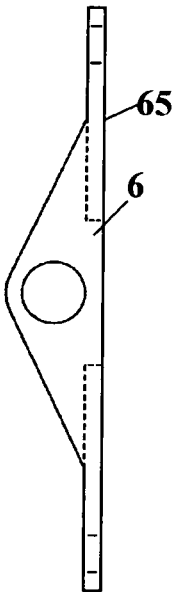
FIG. 11C shows a left-side view of the mounting trunnion of the actuator of FIG. 4.

FIG. 11C shows a left-side view of mounting trunnion 6, the front surface 65 of which usually mounts to the organ console.

Figure 12:
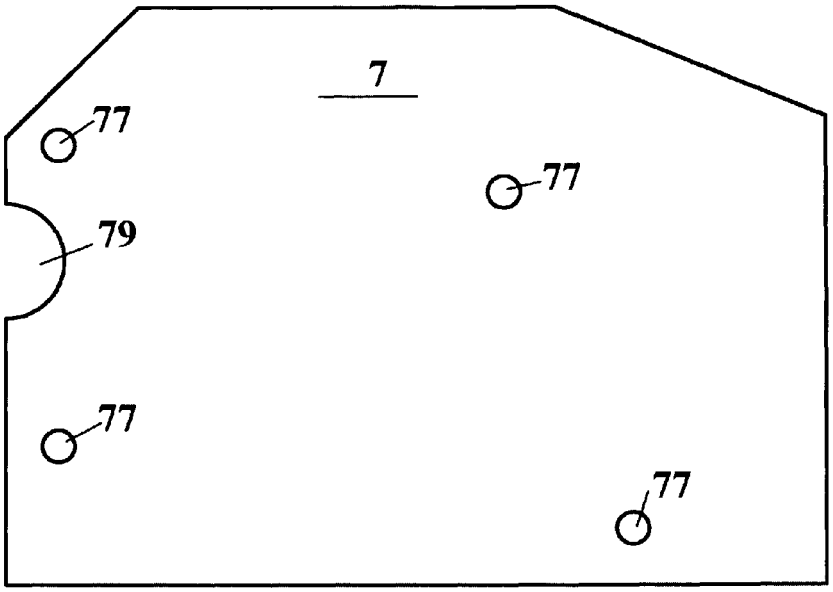
FIG. 12 shows the circuit board of the actuator of FIG. 4.

FIG. 12 shows a right-side view of the circuit board 7 of FIG. 4, which is preferably made of well-known glass-epoxy, 0.063" thick. Shown in this figure are the mounting holes 77 through which to fasten it to the trunnion 4 and the stator 3 of FIG. 4. Cutout 79 insures that circuit board 7 does not interfere with the operation of actuator 1 of FIG. 4.

Figure 13A:
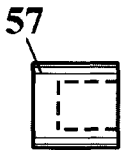
FIG. 13A shows a side view of the cap of the actuator of FIG. 4.

FIG. 13A shows a side view of cap 57 of FIGS. 4 and 5, which is preferably made of nylon, and fits tightly on the tip of screw 55 of FIGS. 4 and 5.

Figure 13B:
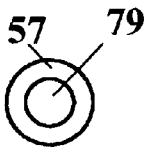
FIG. 13B shows a rear view of the cap of the actuator of FIG. 4.

FIG. 13B shows a rear view of cap 57 and of a hole 79 into which screw 55 fits.

Figure 14A:
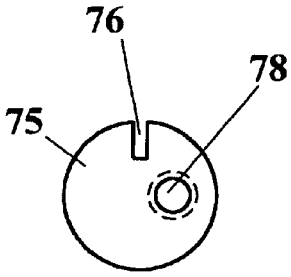
FIG. 14A shows a rear view of the cam of the actuator of FIG. 4.

FIG. 14*a* shows a rear view of cam 75, preferably made of nylon about 0.438" in diameter, and having a threaded hole 78, offset from center about 0.093" and threaded with an undersized internal 6-32 thread that grasps stud 73 of FIG. 10. A slot 76 facilitates screwdriver adjustment from the rear of the actuator 1 of FIG. 4.

Figure 14B:
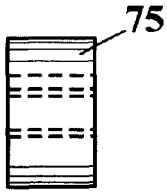
FIG. 14B shows a side view of the cam of the actuator of FIG. 4.

FIG. 14B shows a side view of cam 75.

What is claimed is:

1. A mechanically and electrically operable sector-rotating actuator comprising, a magnetically-permeable rotor that angularly toggles responsive to a mechanical force or to electromagnetically-generated torque, a magnetically-permeable stator, further comprising oppositely-poled permanent magnets and, a coil arranged in a magnetic circuit with the rotor and the stator.

2. An actuator according to claim 1 further comprising, a magnetically-permeable inter-pole angularly intermediate between the stator permanent magnets to attract the rotor when the coil is energized.

3. An actuator according to claim 1 further comprising, a mounting trunnion for adjusting the angular offset of its sector rotation relative to a mounting surface.

4. A stop action magnet according to claim 1.

5. A stop action magnet according claim 4 further comprising, a magnetically-permeable inter-pole angularly intermediate between the stator permanent magnets to attract the rotor when the coil is energized.

6. A stop action magnet according to claim 4, further comprising, a magnetically-permeable pivot upon which the rotor rotates, the pivot having a minimum cross-sectional area greater than 0.006 square inches.

7. A stop action magnet according to claim 4, further comprising, a magnetically-permeable pivot upon which the rotor rotates and, a magnetically-permeable bushing in which the pivot rotates.

8. A stop action magnet according to claim 7 wherein, the magnetically-permeable bushing is permanently lubricated.

9. A stop action magnet according to claim 4 further comprising, a mounting trunnion for adjusting the angular offset of its sector rotation relative to a mounting surface.

10. A stop action magnet according to claim 4 further comprising, a switch responsive to rotor position.

11. A stop action magnet comprising, a magnetically-permeable rotor that angularly toggles responsive to a mechanical force or to electromagnetically-generated torque, a magnetically-permeable stator, further comprising magnetic poles, a gap between the rotor and the stator magnetic poles and, a coil, arranged in a magnetic circuit the reluctance of which, exclusive of the rotor to stator gap reluctance, is less than 0.100 Gilberts per Maxwell.

12. A stop action magnet according to claim 11 further comprising, a mounting trunnion for adjusting the angular offset of its sector rotation relative to a mounting surface.

13. A stop action magnet comprising a mounting trunnion for adjusting the angular offset of its sector rotation relative to a mounting surface.

* * * * *